US007455585B2

(12) United States Patent
Englman

(10) Patent No.: US 7,455,585 B2
(45) Date of Patent: Nov. 25, 2008

(54) ACCUMULATION OF AWARD OPPORTUNITIES DURING SLOT GAME

(75) Inventor: Allon G. Englman, Chicago, IL (US)

(73) Assignee: WMS Gaming, Inc., Waukegan, IL (US)

( * ) Notice: Subject to any disclaimer, the term of this patent is extended or adjusted under 35 U.S.C. 154(b) by 548 days.

(21) Appl. No.: 10/140,594

(22) Filed: May 7, 2002

(65) Prior Publication Data

US 2003/0211879 A1 Nov. 13, 2003

(51) Int. Cl.
*A63F 9/24* (2006.01)

(52) U.S. Cl. ..... 463/16

(58) Field of Classification Search ..... 463/16, 463/20–22; 273/143 R
See application file for complete search history.

(56) References Cited

U.S. PATENT DOCUMENTS

| | | | | |
|---|---|---|---|---|
| 6,015,346 | A | 1/2000 | Bennett | 463/20 |
| 6,089,976 | A | 7/2000 | Schneider et al. | 463/16 |
| 6,190,255 | B1 | 2/2001 | Thomas et al. | 463/20 |
| 6,309,300 | B1 * | 10/2001 | Glavich | 463/26 |
| 6,347,996 | B1 * | 2/2002 | Gilmore et al. | 463/20 |
| 6,443,452 | B1 | 9/2002 | Brune | 273/143 R |
| 6,471,208 | B2 * | 10/2002 | Yoseloff et al. | 273/143 R |
| 6,511,375 | B1 | 1/2003 | Kaminkow | 463/20 |
| 6,514,141 | B1 | 2/2003 | Kaminkow et al. | 463/25 |
| 6,533,273 | B2 * | 3/2003 | Cole et al. | 273/138.1 |
| 6,561,904 | B2 | 5/2003 | Locke et al. | 463/25 |
| 6,575,830 | B2 | 6/2003 | Baerlocher et al. | 463/20 |
| 6,602,137 | B2 * | 8/2003 | Kaminkow et al. | 463/16 |
| 6,634,943 | B1 * | 10/2003 | Baerlocher | 463/25 |
| 6,648,758 | B2 | 11/2003 | Bennett et al. | 463/20 |
| 6,659,864 | B2 | 12/2003 | McGahn et al. | 463/16 |
| 6,663,489 | B2 * | 12/2003 | Baerlocher | 463/20 |
| 6,726,563 | B1 * | 4/2004 | Baerlocher et al. | 463/25 |
| 6,729,618 | B1 | 5/2004 | Koenig et al. | 273/138.2 |
| 6,739,971 | B2 * | 5/2004 | Devaull | 463/20 |
| 6,796,900 | B2 * | 9/2004 | Baerlocher et al. | 463/16 |
| 6,796,905 | B2 | 9/2004 | Baerlocher et al. | 463/25 |
| 6,811,483 | B1 | 11/2004 | Webb et al. | 463/16 |
| 6,890,257 | B2 | 5/2005 | Baerlocher | 463/25 |
| 7,195,559 | B2 | 3/2007 | Gilmore et al. | 463/20 |
| 2001/0046893 | A1 | 11/2001 | Giobbi et al. | 463/24 |
| 2002/0025846 | A1 | 2/2002 | Bennett et al. | 463/20 |
| 2003/0054872 | A1 | 3/2003 | Locke et al. | 463/20 |
| 2003/0162583 | A1 | 8/2003 | Baerlocher | 463/20 |

(Continued)

OTHER PUBLICATIONS

"Secret X" The Price is Right 1978 [online][retrieved on Oct. 16, 2003]. Retrieved from the Internet: URL: http://gscentral.net/secr-retx.htm>.*

(Continued)

*Primary Examiner*—Robert E. Pezzuto
*Assistant Examiner*—Omkar Deodhar

(57) ABSTRACT

A wagering game is conducted on a gaming machine in response to a wager from a player. In addition to a basic game, such as a slot game, the wagering game includes first and second game features. The first game feature is triggered by a start-feature outcome in the basic game and accumulates one or more award opportunities during a series of spins of slot reels. The second game feature realizes the accumulated award opportunities. The second game feature may, for example, be an interactive multi-choice selection feature such that the award opportunities correspond to selections of award-yielding selectable elements included in the selection feature.

20 Claims, 9 Drawing Sheets

U.S. PATENT DOCUMENTS

| | | | | |
|---|---|---|---|---|
| 2003/0162585 | A1 | 8/2003 | Bigelow et al. | 463/20 |
| 2004/0018873 | A1 | 1/2004 | Hughs-Baird et al. | 463/20 |
| 2004/0023707 | A1 | 2/2004 | Maya et al. | 463/16 |
| 2004/0038731 | A1 | 2/2004 | Englman | 463/25 |
| 2004/0053672 | A1 | 3/2004 | Baerlocher | 463/20 |
| 2004/0063493 | A1 | 4/2004 | Baerlocher | 463/25 |
| 2004/0219967 | A1 | 11/2004 | Giobbi et al. | 463/16 |
| 2006/0199634 | A1 | 9/2006 | Anderson et al. | 463/20 |
| 2007/0021183 | A1 | 1/2007 | Fiden et al. | 463/17 |

OTHER PUBLICATIONS

"Master Key" The Price is Right 1983 [online][retrieved on Oct. 16, 2003]. Retrieved from the Internet: URL: http://gscentral.net/key.htm>.*

"Super Ball" The Price is Right 1981 [online][retrieved on Oct. 16, 2003]. Retrieved from the Internet: URL: http://gscentral.net/super.htm>.*

"Plinko" The Price is Right 1983 [online][retrieved on Oct. 16, 2003]. Retrieved from the Internet: URL: http://gscentral.net/plinko.htm>.*

"Secret X" The Price is Right 1978 [online][retrieved on Oct. 16, 2003]. Retrieved from the Internet: URL: <http://gscentral.net/secrretx.htm>.*

"Master Key" The Price is Right 1983 [online][retrieved on Oct. 16, 2003]. Retrieved from the Internet: URL: <http://gscentral.net/key.htm>.*

"Super Ball" The Price is Right 1981 [online][retrieved Oct. 16, 2003]. Retrieved from the Internet: URL: <http://gscentral.net/super.htm>.*

"Series". The Free Dictionary. [online][retrieved on Dec. 20, 2005]. Retrieved from the Internet: URL: <http://www.thefreedictionary.com/series>.*

"'Secret X' The Price is Right" 1978 (online)[retrieved on Dec. 28, 2007]. Retrieved from the Internet: URL <http://gscentral.net/secretx.htm>.

"'Master Key' The Price is Right" 1983 (online)[retrieved on Dec. 28, 2007]. Retrieved from the Internet: URL <http://gscentral.net/key.htm>.

"'Super Ball' The Price is Right" 1981 (online)[retrieved on Dec. 28, 2007]. Retrieved from the Internet: URL <http://gscentral.net/super.htm>.

"'Plinko' The Price is Right" 1983 (online)[retrieved on Dec. 28, 2007]. Retrieved from the Internet: URL <http://gscentral.net/plinko.htm>.

"Spot the Dog" Brochure, by Olympic Video Gaming, two pages, undated.

* cited by examiner

ACCUMULATION OF AWARD OPPORTUNITIES DURING SLOT GAME

FIELD OF THE INVENTION

The present invention relates generally to gaming machines and, more particularly, to a slot machine that accumulates award opportunities during a slot game. The award opportunities may, for example, be selections in an interactive multi-choice bonus feature conducted after the slot game.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome of the basic game. Because the bonus game concept offers tremendous advantages in player appeal and excitement relative to other known games, and because such games are attractive to both players and operators, there is a continuing need to develop new features and themes for bonus games to satisfy the demands of players and operators. Preferably, such new bonus game features and themes will maintain, or even further enhance, the level of player excitement offered by bonus games heretofore known in the art. The present invention is directed to satisfying these needs.

SUMMARY OF THE INVENTION

A wagering game is conducted on a gaming machine in response to a wager from a player. In addition to a basic game, such as a slot game, the wagering game includes first and second game features. The first game feature is triggered by a start-feature outcome in the basic game and accumulates one or more award opportunities during a series of spins of slot reels. The second game feature realizes the accumulated award opportunities. The second game feature may, for example, be an interactive multi-choice selection feature such that the award opportunities correspond to selections of award-yielding selectable elements included in the selection feature.

BRIEF DESCRIPTION OF THE DRAWINGS

The foregoing and other advantages of the invention will become apparent upon reading the following detailed description and upon reference to the drawings in which.

Figure 1:
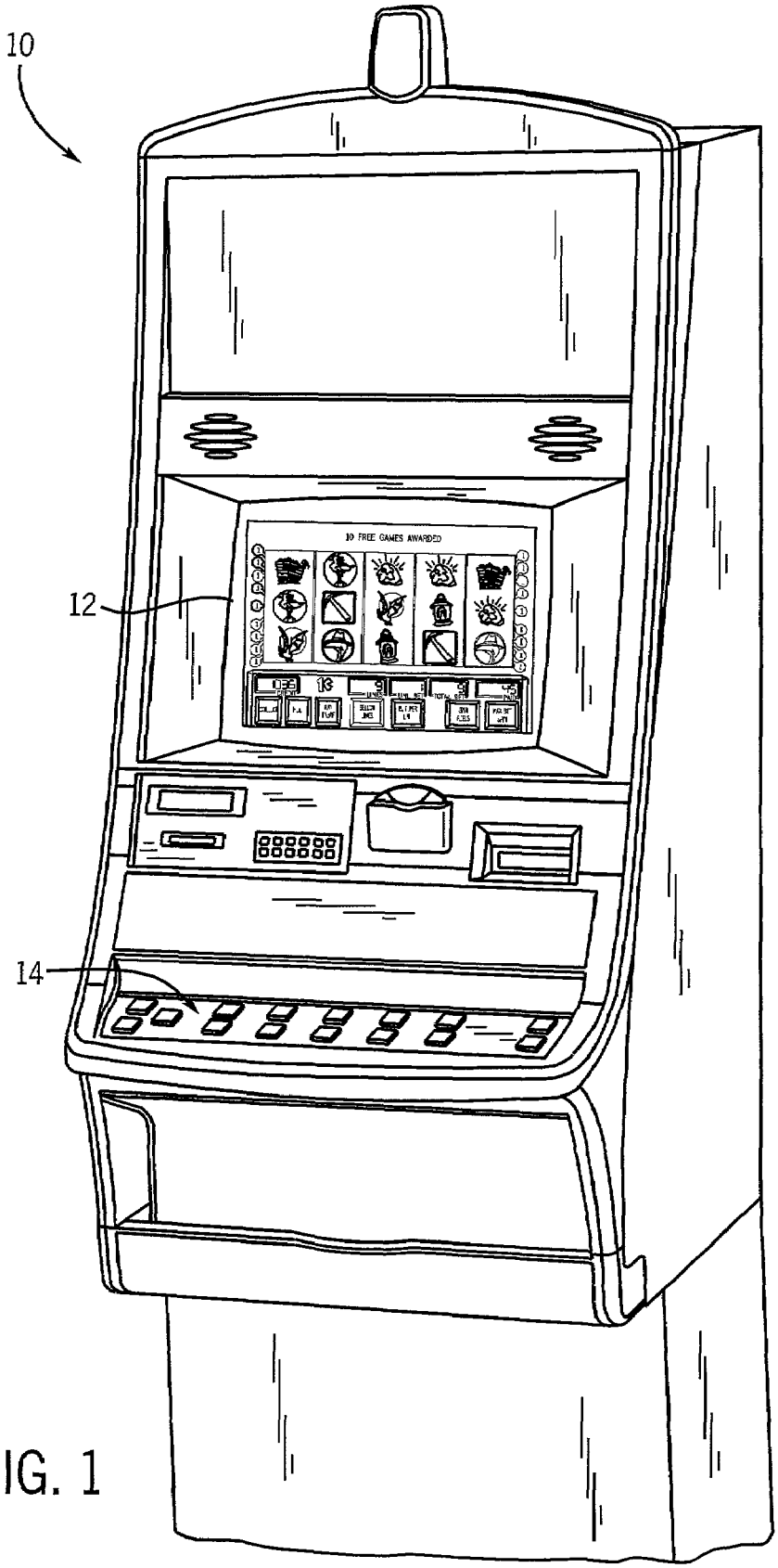
FIG. 1 is a perspective view of a gaming machine embodying the present invention.

While the invention is susceptible to various modifications and alternative forms; specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, a gaming machine 10 is operable to play a wagering game having a mining theme. The wagering game features a basic slot game with five simulated spinning reels and a multiple free spin feature triggered by a start-feature outcome in the basic slot game. The free spin feature may, in turn, trigger an interactive multi-choice bonus feature. In addition to the free spin feature and the multi-choice bonus feature, the basic slot game may produce certain outcomes for triggering other special features and bonus games.

The gaming machine 10 includes a visual display 12 preferably in the form of a dot matrix, CRT, LED, LCD, electroluminescent, or other type of video display known in the art. The display 12 preferably includes a touch screen overlaying the monitor. In the illustrated embodiment, the gaming machine 10 is an "upright" version in which the display 12 is oriented vertically relative to the player. Alternatively, the gaming machine may be a "slant-top" version in which the display 12 is slanted at about a thirty-degree angle toward the player of the gaming machine 10.

Figure 2:
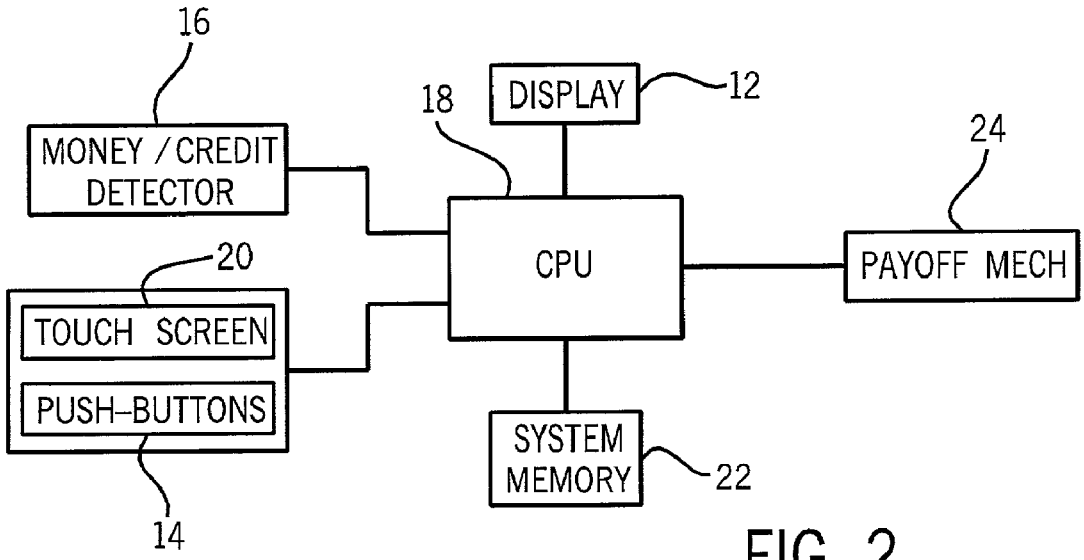
FIG. 2 is a block diagram of a control system suitable for operating the gaming machine.

FIG. 2 is a block diagram of a control system suitable for operating the gaming machine 10. Money/credit detector 16 signals a central processing unit ("CPU") 18 when a player has inserted money or played a number of credits. The money may be provided by coins, bills, tickets, coupons, cards, etc. Then, the CPU 18 operates to execute a game program that causes the display 12 to display five simulated symbol-bearing reels. The player may select a number of pay lines to play, an amount to wager, and start game play via the touch screen 20 or the push-buttons 14, causing the CPU 18 to set the reels in motion, randomly select a game outcome, and then stop the reels to display symbols corresponding to the pre-selected game outcome. In one embodiment, one of the basic game outcomes triggers a multiple free spin feature.

A system memory 22 stores control software, operational instructions and data associated with the gaming machine 10. In one embodiment, the system memory 22 comprises a separate read-only memory (ROM) and battery-backed random-access memory (RAM). However, it will be appreciated that the system memory 22 may be implemented on any of several alternative types of memory structures or may be implemented on a single memory structure. A payoff mechanism 24 is operable in response to instructions from the CPU 18 to award a payoff to the player in response to certain winning outcomes that might occur in the basic game or the multiple free spin feature. The payoff may be provided in the form of coins, bills, tickets, coupons, cards, etc. The payoff amounts are determined by one or more pay tables stored in the system memory 22.

Figure 3:
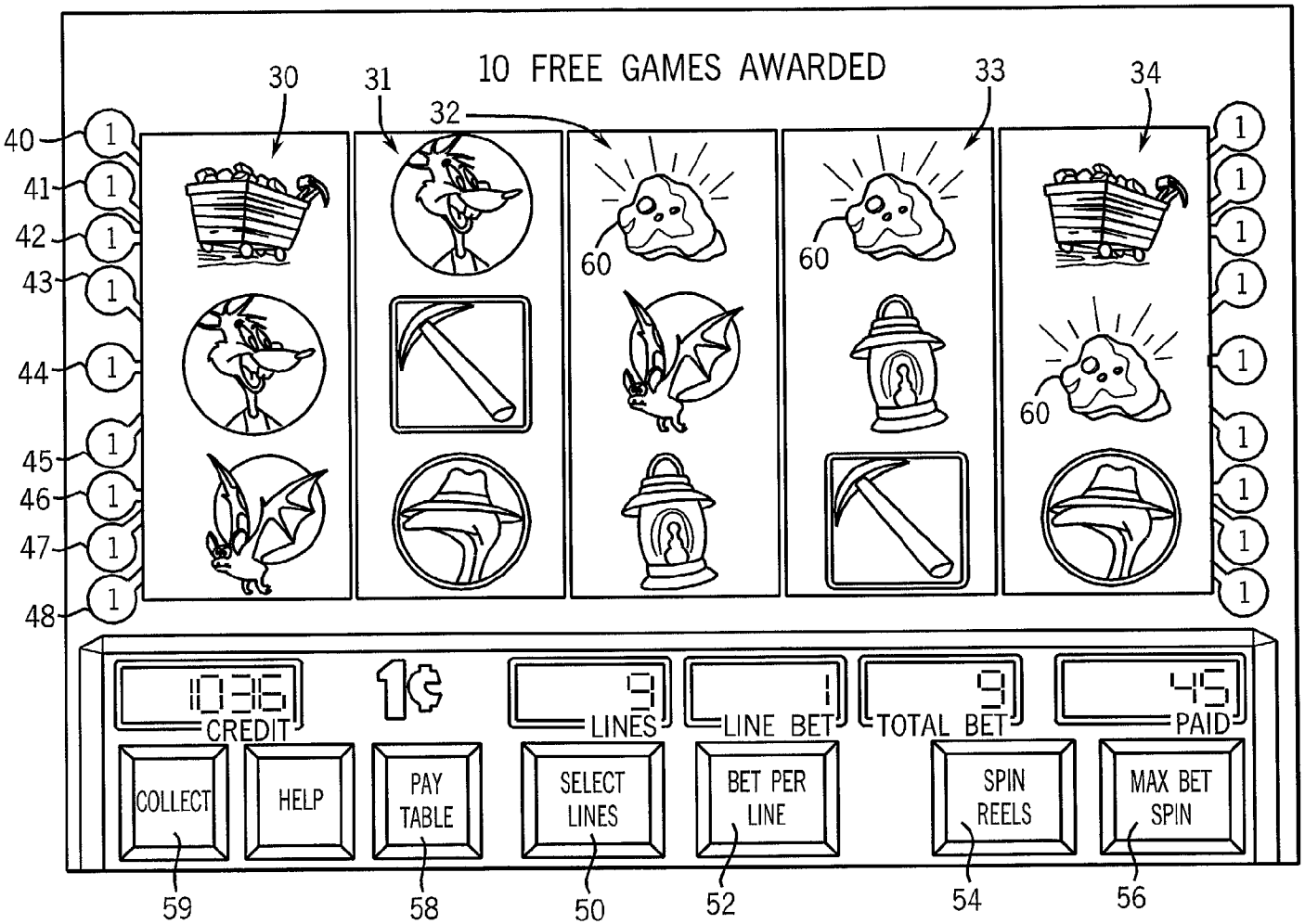
FIG. 3 is a display image associated with a basic slot game and showing a symbol combination for triggering a multiple free spin feature.

Referring to FIG. 3, the basic game is implemented on the display 12 on five video simulated spinning reels 30-34 with nine pay lines 40-48. Each of the pay lines 40-48 extends through one symbol on each of the five reels 30-34. Generally, game play is initiated by inserting money or playing a number of credits, causing the CPU to activate a number of pay lines corresponding to the amount of money or number of credits played. In one embodiment, the player selects the number of pay lines (between one and nine) to play by pressing a "Select Lines" key 50 on the video display 12. The player then chooses the number of coins or credits to bet on the selected pay lines by pressing the "Bet Per Line" key 52.

After activation of the pay lines, the reels 30-34 may be set in motion by touching the "Spin Reels" key 54 or, if the player wishes to bet the maximum amount per line, by using the "Max Bet Spin" key 56 on the video display 12. Alternatively, other mechanisms such as, for example, a lever or push button may be used to set the reels in motion. The CPU uses a random number generator to select a game outcome (e.g., "basic" game outcome) corresponding to a particular set of reel "stop positions." The CPU then causes each of the video reels 30-34 to stop at the appropriate stop position. Video symbols are displayed on the reels 30-34 to graphically illustrate the reel stop positions and indicate whether the stop positions of the reels represent a winning game outcome.

Winning basic game outcomes (e.g., symbol combinations resulting in payment of coins or credits) are identifiable to the player by a pay table. In one embodiment, the pay table is affixed to the machine 10 and/or displayed by the video display 12 in response to a command by the player (e.g., by pressing the "Pay Table" button 58). A winning basic game outcome occurs when the symbols appearing on the reels 30-34 along an active pay line correspond to one of the winning combinations on the pay table. A winning combination, for example, could be three or more matching symbols along an active pay line, where the award is greater as the number of matching symbols along the active pay line increases. If the displayed symbols stop in a winning combination, the game credits the player an amount corresponding to the award in the pay table for that combination multiplied by the amount of credits bet on the winning pay line. The player may collect the amount of accumulated credits by pressing the "Collect" button 59. In one implementation, the winning combinations start from the first reel 30 (left to right) and span adjacent reels. In an alternative implementation, the winning combinations start from either the first reel 30 (left to right) or the fifth reel 34 (right to left) and span adjacent reels.

Included among the plurality of basic game outcomes is a start-feature outcome for triggering play of a multiple free spin feature. A start-feature outcome may be defined in any number of ways. For example, a start-feature outcome occurs when a special start-feature symbol or a special combination of symbols appears on one or more of the reels 30-34. The start-feature outcome may require the combination of symbols to appear along an active pay line, or may alternatively require that the combination of symbols appear anywhere on the display regardless of whether the symbols are along an active pay line. The appearance of the appropriate start-feature outcome causes the CPU to shift operation from the basic game to the multiple free spin feature of the present invention.

In the embodiment illustrated in FIG. 3, three GOLD NUGGET symbols 60 appearing anywhere in the reel display triggers the multiple free spin feature. In the multiple free spin feature, the player is awarded ten free spins of the reels 30-34. For each free spin of the reels 30-34, the CPU generally operates as it did in the basic slot game but, additionally, multiplies the payout awarded for any winning game outcomes by two. Specifically, the CPU randomly selects a game outcome and then rotates and stops the symbol-bearing reels to depict symbols representing the selected game outcome. If the selected game outcome corresponds to a winning outcome (e.g., symbol combinations resulting in payment of coins or credits), the player is awarded twice the payout according to the pay table for the basic slot game. If three scattered GOLD NUGGET symbols 60 appear in the reel display during the free spin feature, the free spin feature is re-triggered.

Figure 4:
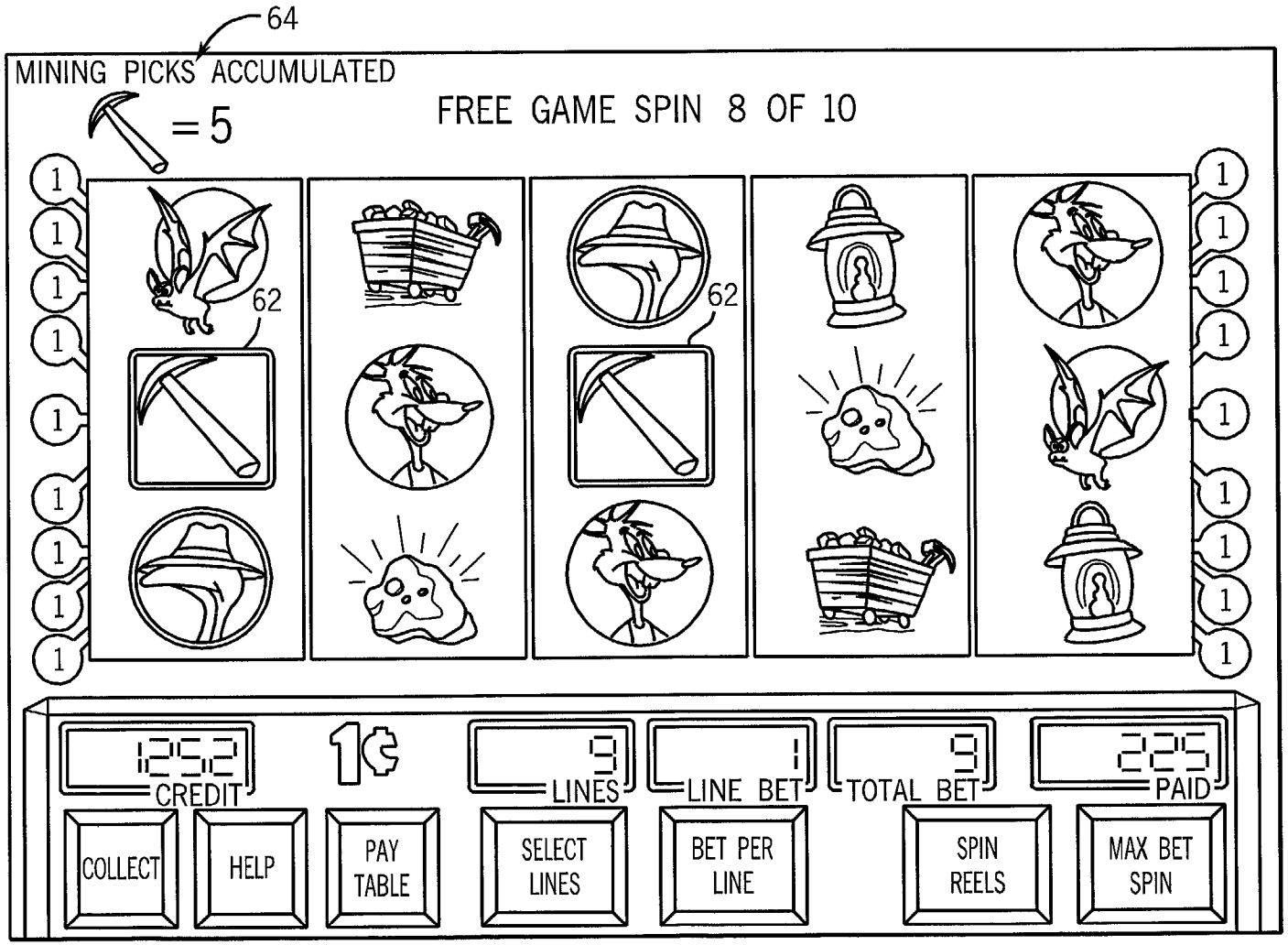
FIG. 4 is a display image associated with the free spin feature.

Referring to FIG. 4, the multiple free spin feature may also trigger an interactive multi-choice bonus feature. During the free spin feature, any MINING PICK symbols 62 appearing in the reel display are accumulated in a mining picks meter 64 shown at the top of the display image. In FIG. 4, for example, the mining picks meter 64 indicates that five MINING PICK symbols 62 have appeared in the reel display as of the end of the eighth free spin in the free spin feature. Alternatively, the meter 64 may accumulate "picks" based on other criteria, such as the number of occurrences of some other reel symbol or symbol combination either during the free spin feature or even during a defined series of plays (e.g., last ten spins) of the basic slot game.

If there are any mining picks accumulated in the mining picks meter 64 at the conclusion of the multiple free spin feature (i.e., the mining picks meter 64 is greater than zero), the interactive multi-choice bonus feature is triggered. In the illustrated example, the CPU enters the multi-choice bonus feature after accumulating five mining picks in the meter 64 during the free spin feature.

Figure 5:
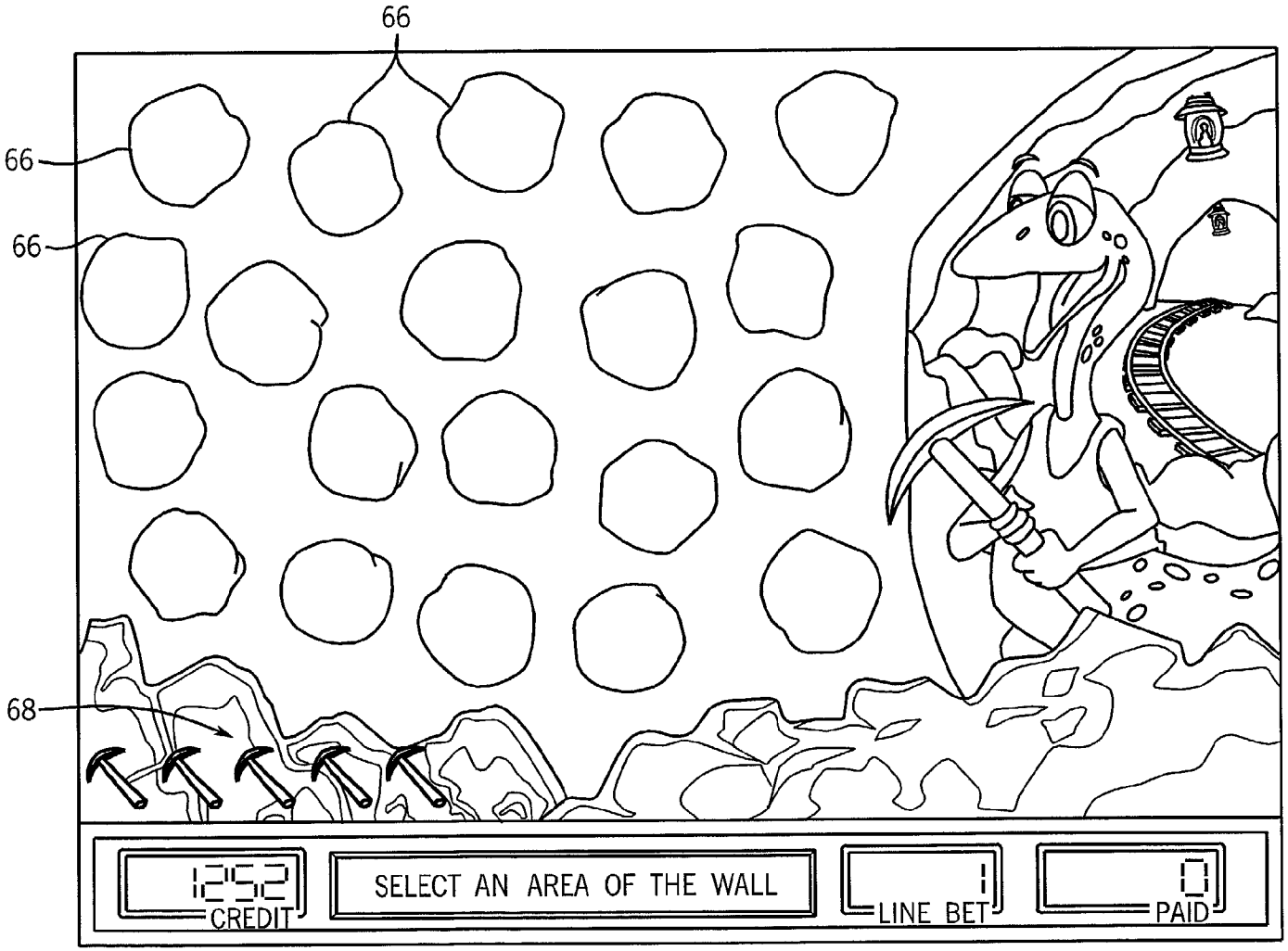
FIGS. 5 through 9 are display images associated with an interactive multi-choice bonus feature that may be triggered by the free spin feature.

Referring to FIG. 5, the image on the display transforms to depict a character holding a pick near a large wall in a mine. The wall includes an array of areas 66 selectable by the player using the touch screen or, in an alternative embodiment, selectable at random by the CPU. The number of selectable areas 66 is illustrated to be twenty but may be varied. The player is allotted a number of selections of the areas 66 corresponding to the number of mining picks accumulated in the meter 64 during the free spin feature and now shown in region 68 of the display image. Each selection represents a bonus opportunity. The player is prompted to select an area of the wall to start "mining" for bonuses. The mining picks in region 68 inform the player as to how many selections remain.

Figure 6:
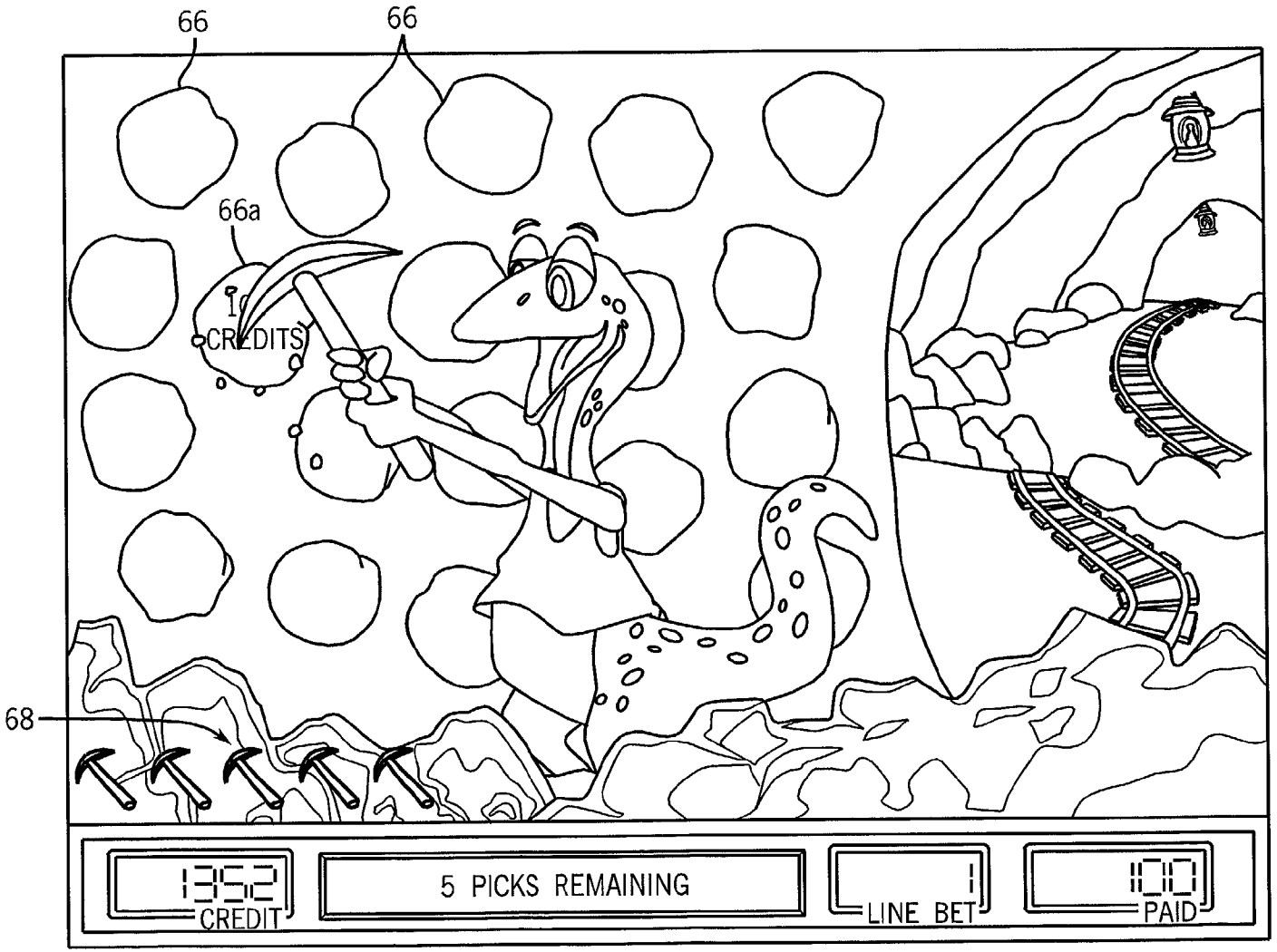
Figure 7:
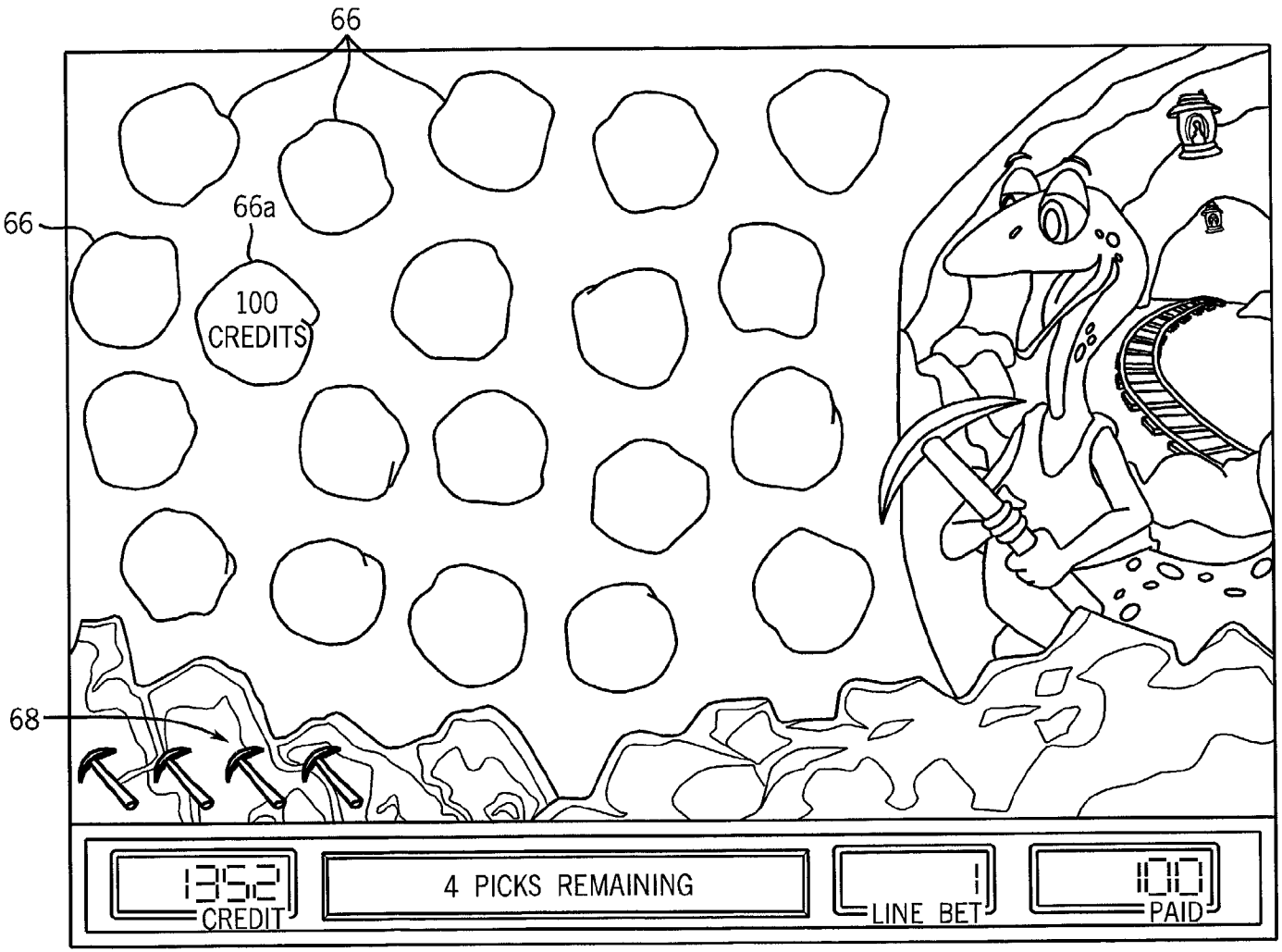

Referring to FIGS. 6 and 7, in response to selecting one of the areas 66, the onscreen character chisels the selected area **66*a* to reveal a bonus such as a credit amount (e.g., between one and 100 credits), a credit multiplier (e.g., between one and twenty times the total initial wager in the basic slot game), a multiplier for the multiple free spin feature just completed, additional selections of areas 66, a number of free reel spins, another game feature with the same or different game format (e.g., poker, bingo, keno, roulette, and blackjack), etc. Credit amounts or credit multipliers are preferably assigned to most of the areas 66. In the illustrated example, the first selected area 66*a* reveals a bonus of 100 credits. After making the selection, the number of mining picks in region 68 is reduced by one (e.g., to four mining picks in FIG. 7**) and the display image states the number of picks remaining.

Figure 8:
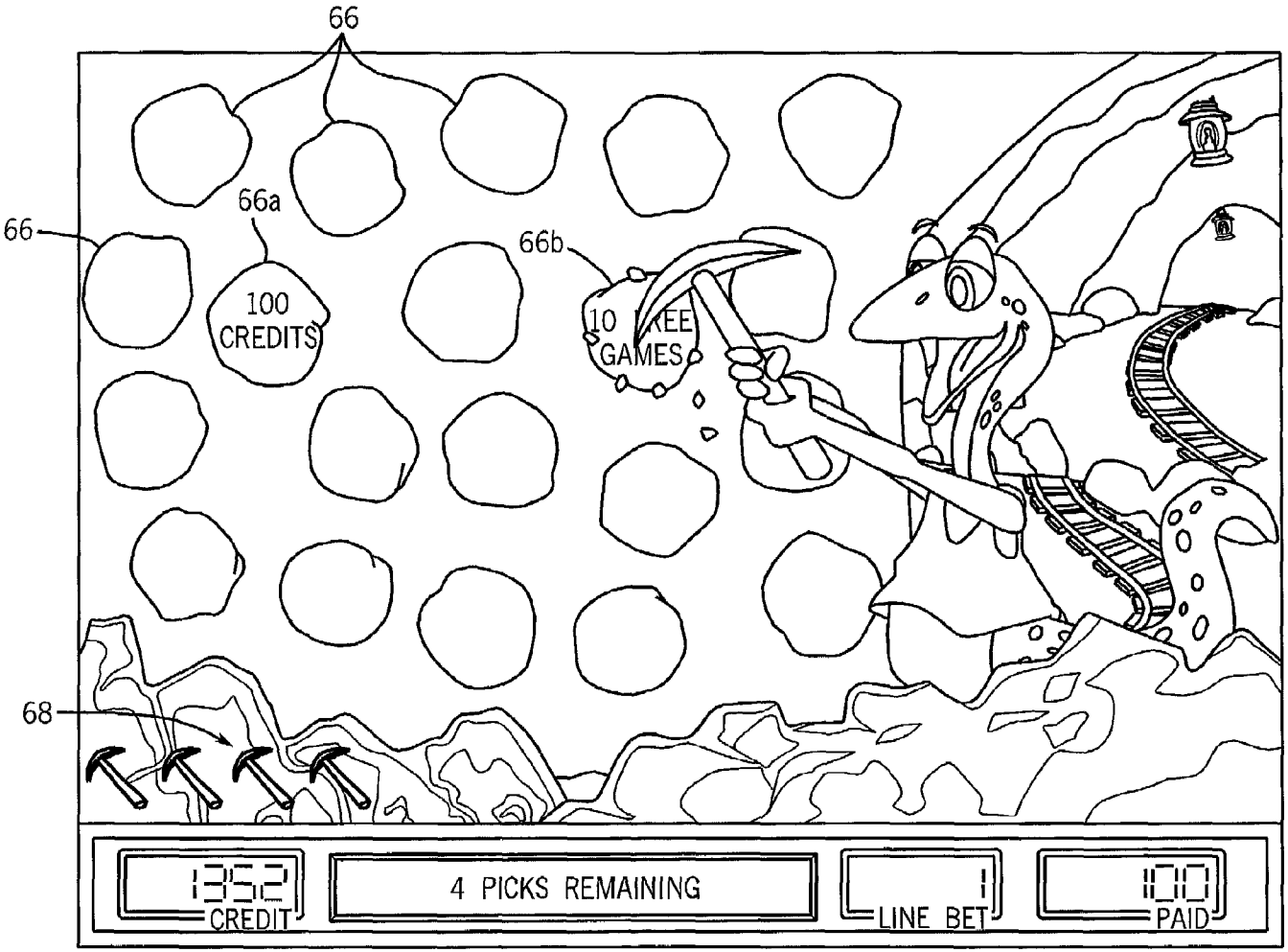
Figure 9:
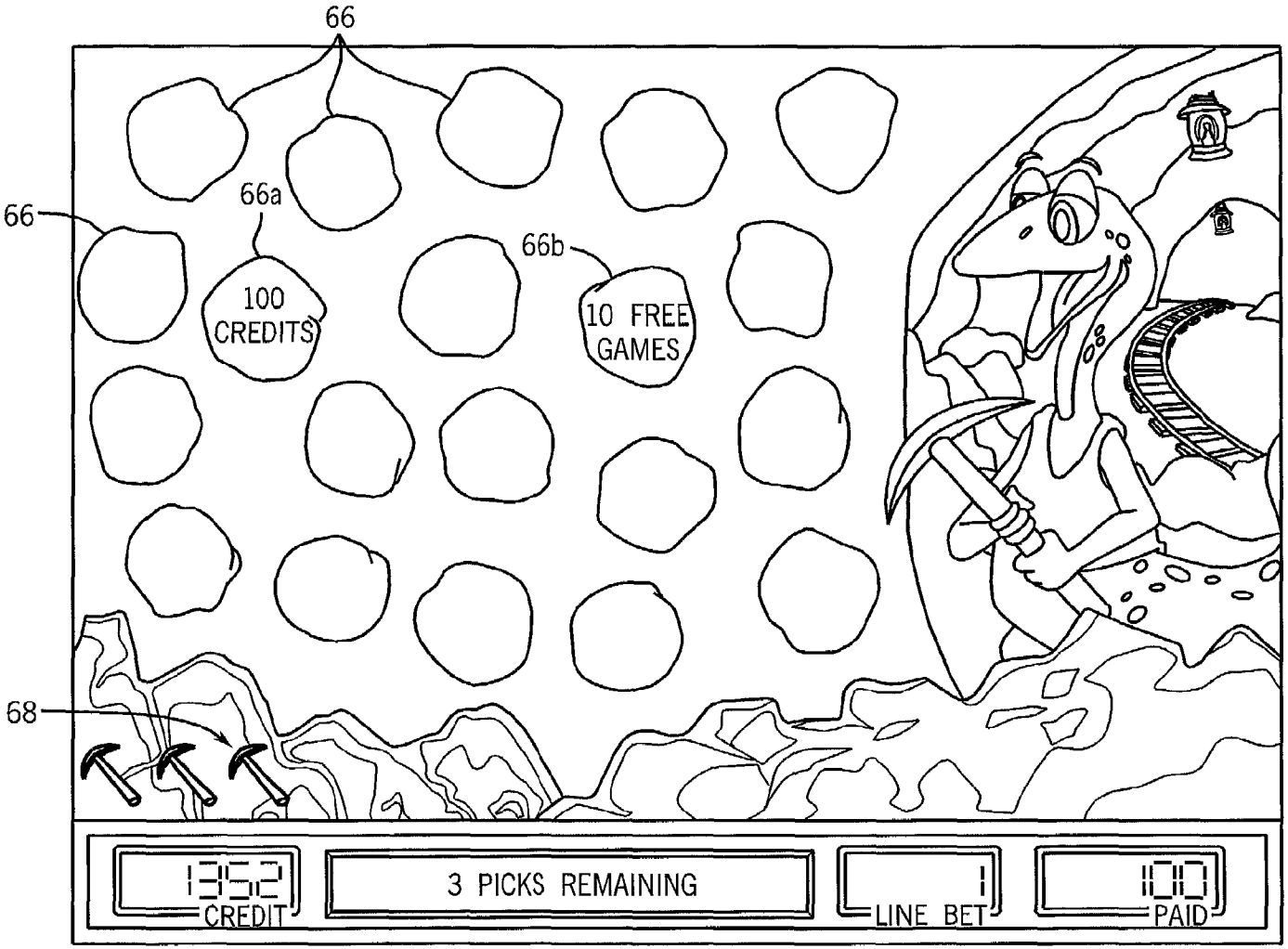

Referring to FIGS. 8 and 9, the next selected area **66*b* reveals a series of ten free spins of the slot reels. After the player has exhausted the allotted number of selections, if any of the selected areas revealed a series of free spins then the CPU shifts operation back to the free spin feature where again any MINING PICK symbols appearing on the reels can be accumulated in the mining picks meter 64** and therefore re-trigger the interactive multi-choice bonus feature. Thus, the various game features can be triggered and re-triggered without requiring the player to place a new wager. After all game features have concluded and none have been re-triggered, the CPU shifts operation back to the basic slot game requiring another wager from the player.

While the present invention has been described with reference to one or more particular embodiments, those skilled in the art will recognize that many changes may be made thereto without departing from the spirit and scope of the present invention. For example, the video simulated reels may be replaced with mechanical reels driven by stepper motors. The basic slot game and the multiple free spin feature are played on the mechanical reels, while a separate video display is provided to play the interactive multi-choice bonus feature. Each of these embodiments and obvious variations thereof is contemplated as falling within the spirit and scope of the claimed invention, which is set forth in the following claims.

What is claimed is:

1. A method of conducting a wagering game on a gaming machine, comprising:

receiving a wager from a player;

providing an opportunity to accumulate a plurality of award opportunities during a series of displays of randomly generated symbol arrays in a first game feature;

accumulating a plurality of award opportunities during said series of displays of randomly generated symbol arrays in said first game feature, at least one award opportunity being awarded for each occurrence of a predetermined reel symbol or symbol combination in any of said randomly generated symbol arrays; and realizing the plurality of award opportunities during a second game feature conducted only subsequent to completion of the accumulating of the plurality of award opportunities during said series of displays of randomly generated symbol arrays in said first game feature, wherein the second game feature is an interactive multi-choice selection feature including a plurality of player-selectable elements, each of the plurality of award opportunities permitting a selection of any of the player-selectable elements for which an award has not been revealed.

2. The method of claim 1, further including conducting a basic game in response to the wager, the first game feature being triggered by a staff-feature outcome in the basic game.

3. The method of claim 2, wherein the basic game is a slot game.

4. The method of claim 1, wherein the award opportunities are accumulated based on a number of occurrences of a prescribed symbol in said series of displays of randomly generated symbol arrays.

5. The method of claim 4, wherein the number of award opportunities corresponds to the number of occurrences of the prescribed symbol in said series of displays of randomly generated symbol arrays.

6. The method of claim 1, wherein a distribution of awards among the plurality of selectable elements is randomized.

7. The method of claim 6, wherein at least one of the plurality of elements selectable by the player is associated with an award opportunity comprising an additional series of displays of randomly generated symbol arrays, which initiates said first feature only following completion of said second feature.

8. The method of claim 6, wherein the step of realizing the award opportunities during the second game feature includes receiving the selections of the selectable elements.

9. The method of claim 8, wherein the selectable elements yield respective awards when selected.

10. A method of conducting a wagering game on a gaming machine, comprising:

receiving a wager from a player;

providing an opportunity to accumulate a plurality of award opportunities during a series of displays of randomly generated symbol arrays in a first game feature;

conducting said first game feature to accumulate a plurality of award opportunities during said series of displays of randomly generated symbol arrays, at least one award opportunity being awarded for each occurrence of a predetermined reel symbol or symbol combination in any of said symbol arrays; and conducting a second game feature only subsequent to the accumulating of the plurality of award opportunities during said series of displays of randomly generated symbol arrays in said first game feature to realize the award opportunities, wherein the second game feature is an interactive multi-choice selection feature including a plurality of player-selectable elements, each of the plurality of award opportunities permitting a selection of any of the player-selectable elements for which an award has not been revealed.

11. The method of claim 10, further including conducting a basic game in response to the wager, the first game feature being triggered by a start-feature outcome in the basic game.

12. The method of claim 10, wherein the award opportunities are accumulated based on a number of occurrences of a prescribed symbol in said series of displays of randomly generated symbol arrays.

13. The method of claim 10, wherein each selectable element reveals an award associated therewith when selected and wherein a distribution of awards among the plurality of selectable elements is randomized.

14. A method of conducting a wagering game on a gaming machine, comprising:

receiving a wager from a player;

conducting a basic game;

conducting a free array display feature in response to a staff-feature outcome in the basic game, the free array display feature including a series of displays of randomly generated symbol arrays;

accumulating, in said free array display feature, a plurality of award opportunities based on a number of occurrences of a prescribed reel symbol or symbol combination in the randomly generated symbol arrays during the series of displays of randomly generated symbol arrays;

conducting, only subsequent to said accumulating of a plurality of award opportunities during said free array display feature, an interactive multi-choice selection feature including a plurality of selections of selectable elements that yield respective awards or potentials for awards when selected; and permitting, in said interactive multi-choice selection feature, a selection of any of the player-selectable elements for which an award has not been revealed for each one of the accumulated plurality of award opportunities.

15. A gaming machine for conducting a wagering game, comprising:

means for receiving a wager from a player;

a first game feature configured to provide an opportunity to accumulate a plurality of award opportunities during a series of displays of randomly generated symbols arrays; and a second game feature for realizing the award opportunities, wherein said second game feature is enabled for play only subsequent to completion of the accumulating of the plurality of award opportunities during said series of displays of randomly generated symbols arrays, and wherein the second game feature is an interactive multi-choice selection feature including a plurality of player-selectable elements, each of the plurality of award opportunities permitting a selection of any of the player-selectable elements for which an award has not been revealed.

16. The machine of claim 15, further including a basic game conducted in response to the wager and including a staff-feature outcome for triggering the first game feature.

17. The machine of claim 16, wherein the basic game is a slot game.

18. The machine of claim 15, wherein the first game feature accumulates the award opportunities based on a number of occurrences of a prescribed symbol in said series of displays of randomly generated symbol arrays.

19. The machine of claim 18, wherein the number of award opportunities corresponds to the number of occurrences of the prescribed reel symbol on the displays of randomly generated symbols arrays during the series of displays.

20. The machine of claim 15, wherein each selectable element reveals an award associated therewith when selected and wherein a distribution of awards among the plurality of selectable elements is randomized.

* * * * *

UNITED STATES PATENT AND TRADEMARK OFFICE

CERTIFICATE OF CORRECTION

PATENT NO. : 7,455,585 B2
APPLICATION NO. : 10/140594
DATED : November 25, 2008
INVENTOR(S) : Allon G. Englman It is certified that error appears in the above-identified patent and that said Letters Patent is hereby corrected as shown below:

Claim 2,
Col. 5, Line 49 Change the term “staff-feature” in claim 2 to read -start-feature-.

Claim 14,
Col. 6, Line 44 Change the term “staff-feature” in claim 14 to read -start-feature-.

Claim 16,
Col. 7, Line 15 Change the term “staff-feature” in claim 16 to read -start-feature-.

Signed and Sealed this

Twenty-fourth Day of February, 2009

John Doll

JOHN DOLL
*Acting Director of the United States Patent and Trademark Office*